United States Patent [19]

Valentino

[11] Patent Number: 4,635,525

[45] Date of Patent: Jan. 13, 1987

[54] JOINING TOGETHER PARTS OF MUSICAL INSTRUMENTS

[76] Inventor: Pete Valentino, P.O. Box 6476, Stateline, Nev. 89449

[21] Appl. No.: 615,900

[22] Filed: May 30, 1984

[51] Int. Cl.[4] ..... G10G 7/00; G10D 9/02

[52] U.S. Cl. ..... 84/453; 84/383 R; 84/452 P

[58] Field of Search ..... 84/330, 380 R–383 R, 84/385–386, 452 P, 453

[56] References Cited

U.S. PATENT DOCUMENTS

| | | | |
|---|---|---|---|
| 2,138,500 | 11/1938 | Miessner | 84/1 |
| 3,308,707 | 3/1967 | Kelischek | 84/380 R |
| 3,438,298 | 4/1969 | Thompson | 84/380 |
| 3,784,235 | 1/1974 | Kessler et al. | 285/21 |
| 3,917,285 | 11/1975 | Swanson et al. | 277/1 |
| 3,937,641 | 2/1976 | Kushner et al. | 156/87 |
| 3,958,484 | 5/1976 | Nelson et al. | 84/380 R |
| 4,023,831 | 5/1977 | Thompson | 285/31 |
| 4,422,364 | 12/1983 | La Volpa | 84/384 |

FOREIGN PATENT DOCUMENTS

| | | | |
|---|---|---|---|
| 651031 | 2/1929 | France | 84/380 |
| 778080 | 3/1935 | France | 84/383 A |

*Primary Examiner*—Lawrence R. Franklin

*Attorney, Agent, or Firm*—Browdy and Neimark

[57] ABSTRACT

A tenon gasket for a musical wind instrument comprises a strip of plastic material having an adhesive layer on one side and adhered around the tenon of the instrument in the form of a sleeve with the ends of the strip butted. Preferably, a thinner buildup strip of adhesive is adhered around the tenon first with the plastic material strip being superimposed thereover and adhering both to the adhesive buildup strip and directly to the tenon. The buildup strip shapes the outer surface of the sleeve. Preferably the plastic material is cross-linked polyethylene exhibiting a lubricated surface property. These strips can be sold as a gasket repair kit in a transparent bag with the adhesive surfaces of the strips releasably covered with paper layers.

7 Claims, 10 Drawing Figures

JOINING TOGETHER PARTS OF MUSICAL INSTRUMENTS

FIELD OF THE INVENTION

This invention relates to musical wind instruments, and more particularly to a method and material for making a gasket for tenon and like joints associated with such musical instruments.

BACKGROUND OF THE INVENTION

It is well known with musical wind instruments such as clarinets, saxophones etc. to employ a band-like cork gasket around the tenon or neck of a tenon joint between two parts of the instrument, for example around the tenon of a clarinet mouthpiece or the neck of a saxophone. Such a cork gasket for a clarinet mouthpiece is disclosed in French Patent No. 778,080 and particularly shown in FIG. 3 thereof.

Such cork gaskets form a good air tight and water tight seal between the tenon and the female socket in an adjacent part or section of the instrument. However, they require skill and time to prepare, secure in place and finish properly.

Consequently, when a musician needs to have a tenon cork gasket replaced, it is necessary to obtain the services of a skilled instrument repair person. This involves cost and also the inconvenience of parting with the instrument for a few days or even a week or more. However, due to its generally satisfactory performance in musical instruments, cork tenon gaskets have been used for a great number of years and nothing equivalent in performance but easier to replace has been found in this time.

It has been highly desirable for many years to have an easier and simpler way of replacing these tenon gaskets.

SUMMARY OF THE INVENTION

It is an object of this invention to provide a more easily replaceable tenon or like gasket for joints between parts of musical instruments.

It is a further object of the invention to provide a method of more easily replacing the cork tenon gaskets in musical wind instruments.

It is yet a further object of this invention to provide a gasket replacement kit for enabling musicians to be able to themselves replace worn tenon or the like gaskets in their musical wind instruments.

A feature by which the above objects are achieved is the use of a self-adhesive strip of plastic material which is applied around the tenon or the like with the ends of the strip forming a butt joint. This has the advantage that the strip is simply formed to the correct length and applied around the tenon, no further finishing operations being necessary. Thus, tenon gaskets can readily be replaced by the musicians themselves on their own musical wind instrument in a matter of minutes.

A further feature is the use of a narrower buildup adhesive strip underneath the self-adhesive plastic strip. This has the advantage of enabling the gasket joint to be "shaped" with improved sealing and gripping in the mating socket of the other instrument part or section.

According to one aspect of the invention, therefore, there is provided in a musical wind instrument having two parts thereof joined together by a male/female joint, a gasket comprising a strip of plastic material in the form of a sleeve surrounding the male component of the joint, the ends of the strip being butted together, and a layer of adhesive on the surface of the strip forming the inner surface of the sleeve adhering the latter to the male component.

Preferably the plastic material is such that the outer surface of the strip exhibits a lubricated property. The strip is preferably somewhat resilient. Cross-linked polyethylene has been found to be an ideal material.

An adhesive buildup strip, of narrower width than the strip of plastic material, may be inserted below the latter strip to shape the outer surface thereof.

According to another aspect of the invention there is provided a method of replacing a tenon gasket in a musical wind instrument comprising the steps of applying a strip of plastic material having an adhesive layer on one side around a tenon of the instrument, causing the adhesive layer to adhere the strip to the tenon, and butting together the ends of the strip so that the strip forms a sleeve around the tenon.

The present invention also envisages the components for replacing a tenon gasket in a wind instrument being in the form of a kit contained in a bag with the adhesive surfaces of the components covered with release paper.

Other objects, features and advantages of the present invention will become more fully apparent from the following detailed description of the preferred embodiment, the appended claims and the accompanying drawing.

DETAILED DESCRIPTION OF THE PREFERRED EMBODIMENTS

Figure 1:
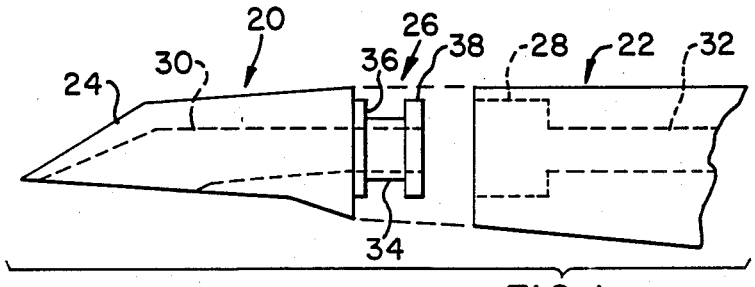
FIG. 1 shows an exploded view in elevation of a clarinet mouthpiece with its tenon gasket removed and a portion of the clarinet in which the mouthpiece engages.

FIG. 1 shows in exploded view a typical mouthpiece 20 of a clarinet and an end portion 22 of the part of the clarinet body in which the mouthpiece 20 engages. One end 24 of the mouthpiece 20 is tapered and shaped to fit between the lips of the musician, and the other end is formed as a tenon 26. The tenon 26 engages in a female socket 28 (shown in broken lines) in the end of the clarinet body 22, with an air passage 30 through the mouthpiece 20 communicating with an air passage 32 through the body of the clarinet. The tenon 26 is formed over the major portion of its length with a shallow annular groove 34 thereby forming in the tenon 26 an inner shoulder 36 and an outer flange 38.

Figure 2:
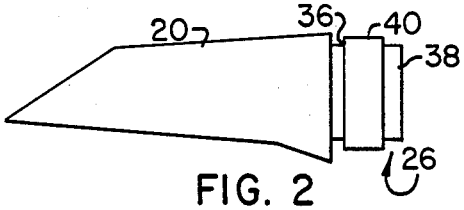
FIG. 2 shows in elevation the clarinet mouthpiece of FIG. 1 with a tenon gasket in place.

FIG. 2 shows the mouthpiece of FIG. 1 with a tenon gasket formed around the tenon 26 and engaging in the groove 34, the sides of the tenon gasket 40 being retained between the shoulder 36 and the flange 38. The main functions of the tenon gasket 40 are to form an airtight seal between the tenon 26 and the socket 28, and also to enable the tenon 26 to be a tight, but removable, fit in the socket 28 so that the mouthpiece 20 is retained firmly in position in use on the clarinet body 22.

Figure 3:
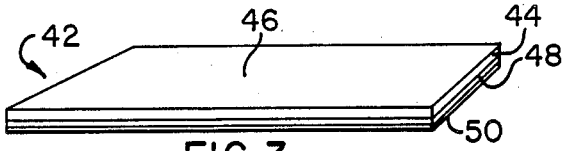
FIG. 3 shows a perspective view from above of a gasket strip according to the invention from which the tenon gasket of FIG. 2 is made.

FIG. 3 shows a gasket strip according to the invention for forming the tenon gasket 40. The gasket strip 42 comprises an outer layer 44 of somewhat resilient plastic material having an exposed surface 46. A layer 48 of adhesive is applied over the other surface of the plastic material layer 44, and a sheet of protective paper 50 is removably applied over the adhesive layer 48 to protect the latter before the tenon gasket is made from the strip 42. The layer 44 is preferably formed of cross-linked polyethylene, the properties of which have been found according to the invention to be highly suitable for these tenon gaskets. This material, apart from being readily deformable, somewhat resilient, and having a high resistance to tearing or disintegration, has the unusual property that its surface has a "lubricated" feeling. This "lubricated" surface property of polyethylene facilitates insertion and withdrawal of the instrument mouthpiece into or onto the body of the musical instrument. The adhesive layer 48 is formed by laminating pressure sensitive adhesive tape to the polyethylene strip 44. The release paper 50 is a typical type of material used for releasably covering adhesive layers, and it resembles a waxed brown paper.

The gasket strip 42 can be made by manufacturing a sheet of polyethylene, laminating the thin adhesive layer 48 to one side thereof, and then covering the layer 48 with a sheet of suitable release paper 50. Each of these steps can be performed by well known technology and so do not require further description. The individual gasket strips 42 are then stamped out of this composite sheet, the exact dimensions of the gasket strip 42 being determined by the particular instrument for which it is intended.

In the simplest form of the invention, to form the tenon gasket 40 in FIG. 2 the gasket strip 42 is cut by scissors or razor blade to the exact length to encircle the tenon groove 34. Then the release strip 50 is peeled from the gasket strip 42, and the gasket strip placed in the groove 34 and then wound around the tenon 26 to completely encircle the latter with the ends of the gasket strip 42 forming a butt joint. The gasket strip 42 is pressed firmly with the fingers against the surface of the groove 34, and then the outer surface 46 of the gasket strip 42 smoothed with the fingers to complete formation of the tenon gasket 40. As can be seen in FIG. 2, a tenon gasket 40 formed in this way protrudes slightly at its edges above the surface of the tenon 26, i.e. slightly above the flange 38 and the shoulder 36.

Figure 4:
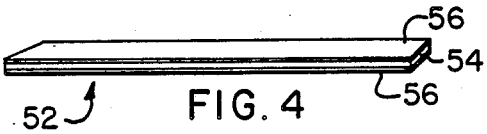
FIG. 4 shows a perspective view from above of a narrower adhesive buildup strip which is preferably also employed in forming the tenon gasket of FIG. 2.

FIG. 4 shows an adhesive strip 52 which is also preferably used in making the tenon gasket 40. The adhesive strip 52 is approximately the same length as the gasket strip 42 but is substantially narrower, for example, the adhesive strip 52 may be approximately half the width of the gasket strip 42, or may be even less than one third the width thereof. The adhesive strip 52 is formed by a central strip of adhesive 54 covered on both sides by releasable paper strips 56 of similar material to the release strip 50 in FIG. 3. The adhesive layer 54 is self supporting and is adhesive on both surfaces. This layer 54 is very thin, preferably of the order of ten thousandths of an inch. Such thin self supporting adhesive layers are well known and need not be described further.

Figure 6:
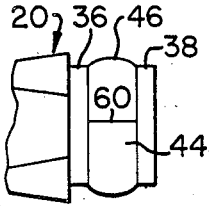
FIG. 6 shows a view similar to FIG. 5 with the gasket strip of FIG. 3 applied to form the tenon gasket.
Figure 5:
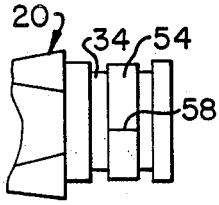
FIG. 5 shows an underneath plan view of the tenon of the mouthpiece of FIGS. 1 and 2 to which the adhesive buildup strip of FIG. 4 has been applied.

To form a preferred tenon gasket according to the invention, the release paper strips 56 are peeled from each side of the adhesive layer 54, and then the layer 54 is applied around the mid-portion of the tenon groove 34 as shown in FIG. 5, with the ends of the adhesive layer 54 forming a butt joint 58. FIG. 5 is an underneath plan view of the tenon end of the mouthpiece 20 of FIG. 1, and as can be seen the butt joint 58 is preferably disposed on the underside of the mouthpiece. Also, as can be seen from FIG. 5, the adhesive band formed by the adhesive strip around the groove 34 in the tenon is approximately in the center of the groove and occupies approximately one third of the length of the groove, leaving approximately a third of the length of the groove at each end unoccupied. Also, as can be seen in FIG. 5, the thickness of the adhesive layer 54 is less than the depth of the groove 34. To complete the tenon gasket, the gasket strip 42 of FIG. 3 is applied around the groove 34 as previously described, after having removed the release paper 50. The butt joint 60 formed by the ends of the polyethylene strip 44 is also preferably located on the underside of the mouthpiece 20, as shown in FIG. 6, and preferably located a small distance to one side of the butt joint 58 of the adhesive layer 54. The adhesive surface of the gasket strip 46 adheres to the bottom surface of the groove 34 on each side of the adhesive band 54, and also adheres strongly at its center to the outer adhesive surface of the adhesive band 54. The central band or adhesive buildup strip 54 causes the outer surface 46 of the gasket strip 44 to be outwardly convexly curved across the width of the groove 34. This convex curving of the surface 46 between the top of the shoulder 36 and the flange 38 can be seen in FIG. 6. This slight increase in diameter at the center of the tenon gasket caused by the adhesive buildup strip 54 enables a better connection to be made between the tenon of the mouthpiece and the receiving socket 28 in the instrument. Further, this bulging or convexing curvature of the outer surface 46 facilitates insertion of the tenon 26 into and withdrawal from the socket 28, this being further facilitated by the lubricated nature of the surface 46 of the polyethylene.

Figure 7:
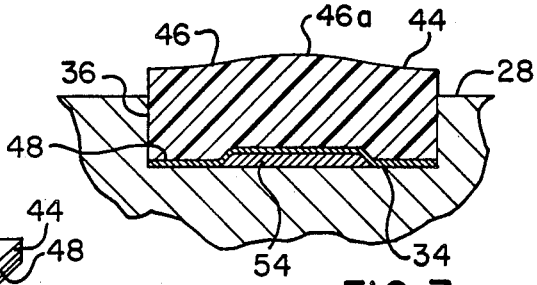
FIG. 7 shows, on a larger scale, a radial section through a portion of the tenon gasket of FIG. 6.

FIG. 7 shows, on a larger scale, a section on a radial plane through the central axis of the clarinet mouthpiece of the tenon gasket. The adhesive layer 48 on the inner surface of the gasket strip 44 can be seen contacting the bottom of the tenon groove 34 on each side of the adhesive buildup strip 54, and being diverted upwardly over its mid-portion by the adhesive buildup strip 54. This results in the mid-portion **46*a* of the outer lubricated surface 46 of the polyethylene gasket strip 44 being raised to create the somewhat convex shaping of the outer surface 46**.

It will be appreciated, therefore, how easy it is for a musician to replace a tenon gasket on his or her musical instrument. The defective tenon gasket is first removed, then the surface of the tenon groove 34 cleaned. Next the thin adhesive buildup strip 54 is installed around the center area of the tenon groove 34 with the formation of the butt joint at its ends, and finally the polyethylene gasket strip 44 is installed in the tenon groove 34 over the adhesive buildup strip 54. If necessary the strips are cut to the correct length before being so installed, and after installation any excess is cut off using a knife or razor blade.

The thickness of the cross-linked polyethylene layer 44 is approximately one thirty-secondth of an inch. The typical length and width of the gasket strip 42 for a clarinet mouthpiece is three and half inches long and seven sixteenths of an inch wide. In conjunction therewith the length of the adhesive buildup strip 54 is approximately the same and the width thereof should preferably be approximately an eighth of an inch.

As will be appreciated, these gaskets strips and adhesive buildup strips should be made in different widths to accommodate the tenons, or necks, on various instruments, for example with a clarinet the mouthpiece, top, middle and lower sections might have different widths. The tenon gasket of the present invention can be used to replace conventional cork tenon gaskets on any wind musical instrument having two parts thereof connected together by a male/female connection, for example alto clarinets, bass clarinets, bassoons, saxophones, etc.

Another preferred embodiment of the invention particularly for use with instruments where the tenon is in the form of a neck will now be described with reference to FIGS. 8 and 9.

Figure 8:
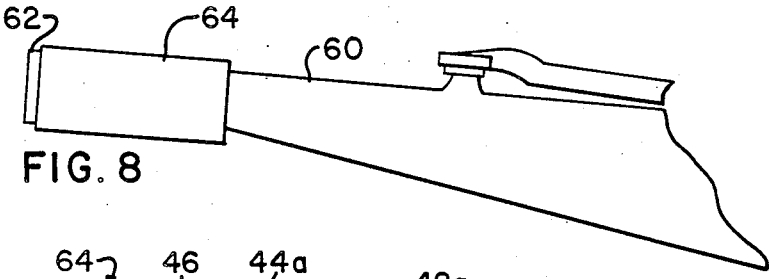
FIG. 8 shows in elevation a neck of a saxophone having a tenon gasket according to the invention.

FIG. 8 shows the neck 60 of a saxophone, the neck terminating in an outwardly extending flange 62 adjacent to which a tenon gasket 64 surrounds the neck 60. This tenon gasket 64 is substantially longer than the clarinet mouthpiece tenon gasket 40, for example two to three times the length or even greater.

Figure 9:
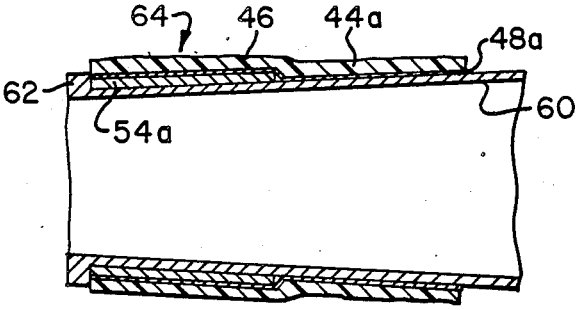
FIG. 9 shows a vertical section through the tenon gasket of FIG. 8.

FIG. 9 shows a vertical section through the tenon gasket 64 of FIG. 8. The tenon gasket 64 is formed by applying an adhesive strip **54*a* around the neck 60 adjacent the flange 62 with the ends of the strip 54*a* being butted. The strip 54*a* is the same as the strip 54, except wider, and before being so applied had its adhesive surfaces covered by protective release paper strips. The width of the adhesive buildup strip 54*a* is approximately half the width of the complete tenon gasket 64. Around the outside of the adhesive buildup strip 54*a* and a portion of the neck 60 is a polyethylene gasket strip 44*a*, the inner surface of which has an adhesive layer 48*a*. The ends of the strip 44*a* are also butted together. The strip 44*a* and the adhesive layer 48*a* are made the same as the gasket strip 42 of FIG. 3, the protective release paper 50 having been removed. The neck 60 of the saxophone is slightly frusto conical, and diverges outwardly slightly in the direction away from the flange 62, as can be clearly seen in FIG. 8. The adhesive buildup strip 54*a* functions to compensate for this frusto conical shape of the neck 60 so that the outer surface 46 of the tenon gasket is approximately cylindrical in shape so facilitating a better and firmer fit of the saxophone mouthpiece over the tenon gasket 64. For a typical alto saxophone the width of the polyethylene gasket strip 44*a* is approximately one and one quarter inches and the width of the adhesive buildup strip 54*a* is approximately five eighths of an inch. With the longer length of this saxophone neck gasket 64, the lubricated surface property of the cross-linked polyethylene strip 44*a*** is particularly advantageous for easier connection and removal of the saxophone mouthpiece.

Figure 10:
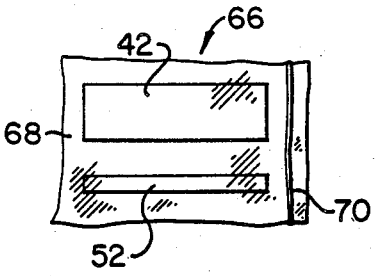
FIG. 10 shows a plan view of a kit of parts according to the invention for making the tenon gasket of FIG. 2 or FIG. 8.

FIG. 10 illustrates an example of the manner in which a kit can be sold for replacing tenon cork gaskets on musical wind instruments. The kit 66 comprises one or more polyethylene gasket strips 42 together with one or more adhesive strips 52 contained in a transparent plastic bag 68 closed by a zipper 70 of the ziplock type. A musician can conveniently carry one or more of these kits in the case of his or her musical instrument together with a small knife or razor blade. The musician is then in a position to replace any worn tenon gasket whenever this becomes necessary, for example during an interlude in a performance. Such a facility has hithertofore not been available to players to musical wind instruments, and by enabling expedient gasket replacements to be effected avoids the instrument having to be out of use for a period of time to be repaired.

The above described embodiments, of course, are not to be construed as limiting the breadth of the present invention. Modifications, and other alternative constructions, will be apparent which are within the spirit and scope of the invention as defined in the appended claims.

What is claimed is:

1. In a musical wind instrument having two parts thereof joined together by a male/female joint, the arrangement comprising a gasket around the male component of said joint and said gasket comprising a strip of plastic material in the form of a sleeve surrounding said male component, the ends of said strip being butted together, a layer of adhesive on the surface of said strip forming the inner surface of said sleeve, and a strip of adhesive applied around said male component and adhering thereto, said strip of plastic material overlying said adhesive strip with said adhesive layer adhering to said adhesive strip.

2. The arrangement of claim 1, wherein said adhesive strip is narrower than said strip of plastic material.

3. The arrangement of claim 2, wherein part of the width of said adhesive layer adheres directly to said male component, and said adhesive strip causes the outer surface of said sleeve to be deformed from the contour of the outer surface of said male component.

4. The arrangement of claim 3, wherein said adhesive layer adheres directly to said male component on each side of said adhesive strip, and the outer surface of said sleeve is convex.

5. The arrangement of claim 3, wherein said male component is frusto conical and said adhesive strip is positioned adjacent one end only of said sleeve to render the outer surface of said sleeve less frusto conical and more cylindrical.

6. The arrangement of claim 5, wherein said plastic material is cross-linked polyethylene, said adhesive strip is thinner than said plastic material strip, and said adhesive strip has a width no greater than half the width of said plastic material strip.

7. A method of replacing a gasket on a male component of a male/female joint in a musical wind instrument, comprising the steps of:

applying a strip of plastic material having an adhesive layer on one side thereof around the male component;

causing said adhesive layer to adhere said strip to said male component;

butting together the ends of said strip so that said strip forms a sleeve around said male component; and applying an adhesive buildup strip around said male component, said adhesive buildup strip being adhesive on opposite sides thereof and being narrower in width than said strip of plastic material, said strip of plastic material being applied over said adhesive buildup strip with said adhesive layer of said strip of plastic material adhering to said adhesive buildup strip and also adhering directly to said male component.

* * * * *